US009506123B2

(12) United States Patent
Woods et al.

(10) Patent No.: US 9,506,123 B2
(45) Date of Patent: Nov. 29, 2016

(54) PURGE PLUG

(71) Applicant: VESUVIUS CRUCIBLE COMPANY, Wilmington, DE (US)

(72) Inventors: Paul Woods, Cranberry Township, PA (US); Roy Phillips, Strongsville, OH (US)

(73) Assignee: VESUVIUS CRUCIBLE COMPANY, Wilmington, DE (US)

( * ) Notice: Subject to any disclaimer, the term of this patent is extended or adjusted under 35 U.S.C. 154(b) by 100 days.

(21) Appl. No.: 14/395,912

(22) PCT Filed: Mar. 15, 2013

(86) PCT No.: PCT/US2013/032282

§ 371 (c)(1),
(2) Date: Oct. 21, 2014

(87) PCT Pub. No.: WO2013/172975

PCT Pub. Date: Nov. 21, 2013

(65) Prior Publication Data

US 2015/0115510 A1 Apr. 30, 2015

Related U.S. Application Data

(60) Provisional application No. 61/649,065, filed on May 18, 2012.

(51) Int. Cl.

| | |
|---|---|
| ***C21C 5/48*** | (2006.01) |
| ***C21C 5/34*** | (2006.01) |
| ***B22D 1/00*** | (2006.01) |

(52) U.S. Cl.

CPC ..... *C21C 5/48* (2013.01); *B22D 1/005* (2013.01); *C21C 5/34* (2013.01)

(58) Field of Classification Search

CPC ..... C21C 5/48
USPC ..... 266/220
See application file for complete search history.

(56) References Cited

U.S. PATENT DOCUMENTS

| | | | | |
|---|---|---|---|---|
| 3,615,086 | A | 10/1971 | Jepson, III et al. | |
| 4,632,367 | A | 12/1986 | LaBate | |
| 4,706,944 | A | 11/1987 | Lee | |
| 4,826,139 | A | 5/1989 | Van Es | |
| 4,836,433 | A | 6/1989 | Perri | |
| 4,995,594 | A | 2/1991 | Verbik | |
| 5,249,779 | A | 10/1993 | LaBate, II | |
| 5,303,905 | A | 4/1994 | Pohl et al. | |
| 6,231,806 | B1 | 5/2001 | Rodrigues et al. | |
| 2015/0115510 | A1* | 4/2015 | Woods | B22D 1/005 266/217 |

FOREIGN PATENT DOCUMENTS

| | | | |
|---|---|---|---|
| AU | 652480 | B2 | 8/1994 |
| EP | 0080403 | A1 | 6/1983 |
| WO | 01/83831 | A1 | 11/2001 |

* cited by examiner

*Primary Examiner* — Scott Kastler
(74) *Attorney, Agent, or Firm* — Thomas Clinton; Donald M. Satina

(57) ABSTRACT

A refractory device, such as a replacement purge plug containing a refractory material, is configured to be inserted in the bottom of a ladle for introducing purging gas through a heat of molten metal in a ladle. One or more geometrical features on the lateral surface of the purge plug facilitate the installation of the purge plug into a housing block that has been subjected to erosion.

17 Claims, 6 Drawing Sheets

PURGE PLUG

BACKGROUND OF THE INVENTION (1) Field of the Invention

The invention relates to a purge plug, containing a refractory material, configured to be inserted in the bottom of a ladle for introducing purging gas through a heat of molten metal in the ladle.

(2) Description of the Related Art

The steel manufacturing process makes use of a vessel, called a ladle, which is lined with a refractory material to contain the molten steel. A purge plug is a device, installed in a passage through the exterior of the ladle, which is configured to introduce gas into the interior of the ladle. The plug may incorporate pores or passages to permit gas flow. The function of the purge plug is to provide gas stirring of the molten metal, thereby promoting thermal and chemical homogenization. The purging gas may also modify the heat (molten contents of the ladle). Stirring is normally accomplished by percolating argon or nitrogen gas through the purge plug in the bottom of the ladle. Typically, a purge plug has the shape of a truncated ceramic cone (frustum) and is enclosed in a sheet-metal casing.

In a typical configuration, the purge plug is replaceably mounted in a housing block installed in the bottom of the ladle. In the ladle, various high-temperature processes are carried out in which the purge plug is crucial. The purge plug is worn heavily during the process in its uppermost portion, which is directed towards the heat, and regularly has to be replaced by a new purge plug when its height has shrunk to a minimum permissible level. In addition, the portion of the housing block surrounding the uppermost portion of the purge plug experiences erosion. Consequently, the lateral surfaces of the purge plug are increasingly exposed to erosion as the housing block erodes, and the area of the housing block in contact with the purge plug decreases. Results of decreased contact area include mechanical instability, failure of refractory components and increased probability of breakout.

In many steel shops it is common practice to bomb or gun around a new plug installed in a used or worn housing block in order to fill any void in a worn block and to build up the ladle bottom around the newly installed plug. This procedure adds to the life of the plug installed in the worn housing block. Bombing around the new plug involves dropping refractory material from the top of the ladle around the newly installed plug in a worn housing block. Gunning involves shooting refractory material with a gunning machine against the ladle bottom and housing block surrounding the new plug in a worn housing block.

Gunning or bombing around the plug does increase the life of the plug and housing block. However in many cases the material will shear off the top of the housing block exposing the steel can of the purge plug to liquid steel. This liquid metal contact melts the steel can and the purge plug will usually shear off to a level at a height where solid refractory material surrounds the purge plug.

Plug life is greatly affected by how well the material deposited by ladle bomb or by gunning stays in place around the purge plug. The application of cement around the purge plug may leave gaps and voids that are subject to infiltration and increased erosion rate of the repaired piece. Replacement purge plugs currently in use are configured with a smooth radial surface that facilitates the placement of the purge plug in the housing block, but does not facilitate the bonding of the radial surface of the purge plug to the material deposited by ladle bombing or gunning.

If the repair, by ladle bomb or gunning, around the purge plug can be made to stay in place, plug shearing will be reduced and both plug life and housing block life will be increased. There still exists a need for a process or configuration for repair of the housing block in which the purge plug is anchored to the housing block to prevent infiltration, and the housing block is anchored to the purge plug to prevent portions of the repaired housing block from working free. There also exists a need for a process or configuration for repair of refractory pieces with similar configurations, such as well blocks around the inner nozzle of a slide gate.

BRIEF SUMMARY OF THE INVENTION

Accordingly, the present invention is directed to a purge plug having one or more geometrical features on its lateral surface that simultaneously permit the purge plug to be seated in an eroded housing block and also anchor the purge plug and the repaired portions of the housing block to each other. The present invention is also directed to well nozzles and to similar refractory pieces that are subjected to erosion, or are seated in blocks that are subjected to erosion. Although it is much less common to repair slide gate well blocks than to repair purge plug housing blocks, the same principles may be applied. In most cases a well nozzle for a slide gate does not have a steel can, however, a small steel banc may be added to the well nozzle in order to attach anchors or incorporate geometric features as described for the purge plug.

DETAILED DESCRIPTION OF THE INVENTION

Figure 1:
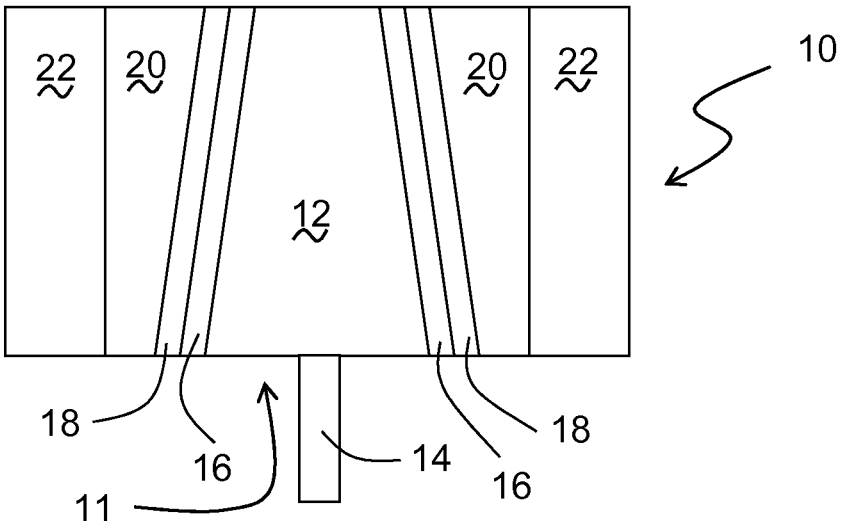
Fig. 1 Prior Art
FIG. 1 is a section drawing showing a purge plug of the prior art in a housing block, and the combination of the purge plug and housing block mounted in a ladle bottom.

Purge plugs are formed from refractory materials, and generally take the form of a cylinder, truncated cone (frustum) or truncated pyramid (pyramidal frustum). FIG. 1 shows an assembly 10 of a purge plug 11 installed for use. The body 12 of the purge plug 11 is provided with channels or porous refractory materials so that gas can be introduced through an inlet 14 disposed at a supply end of the body of the purge plug to a working end of the purge plug. A lateral face of the purge plug, joining the supply end and the working end, is shielded by a housing 16, generally constructed of metal. The purge plug is installed in a working position by introducing mortar 18 between the lateral face of the purge plug and an interior surface of a block 20 configured to receive the lateral surface, so that gas can be supplied through the supply end of the purge plug and introduced into the interior of a metallurgical vessel at the working end of the purge plug. The block is housed within a floor 22 or wall of a metallurgical vessel. In typical installations the block is surrounded by refractory material.

Figure 2:
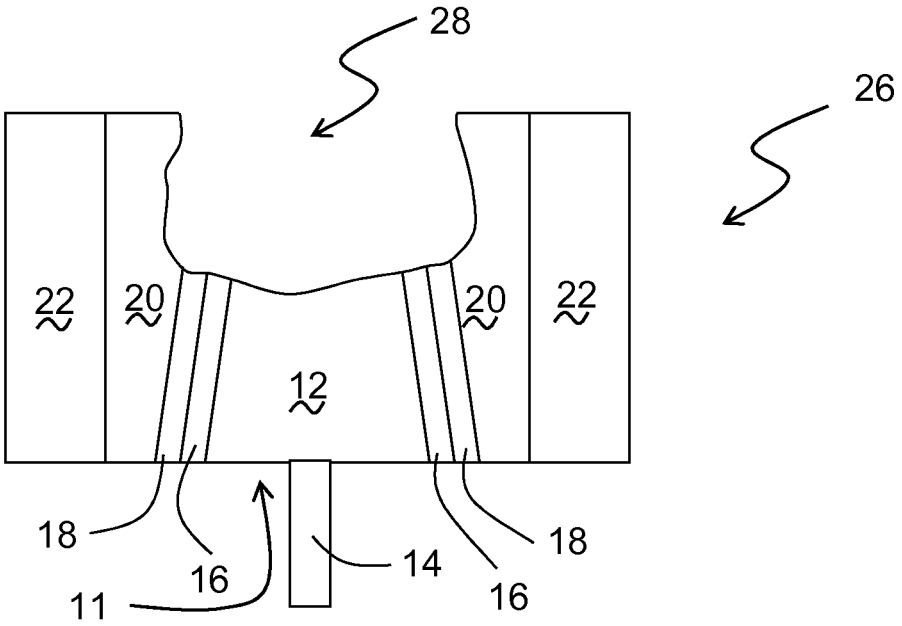
Fig. 2 Prior Art
FIG. 2 is a section drawing showing an eroded purge plug of the prior art in an eroded housing block, and the combination of the purge plug and housing block mounted in a ladle bottom.

FIG. 2 shows an assembly 26 of a purge plug 11, having a purge plug body 12 into which gas may be introduced through an inlet 14. The lateral face of purge plug 11 is enclosed in housing 16, and is held in block 20 by mortar 18. Block 20 extends through floor 22 of a metallurgical vessel. The combination of the purge plug and the block has been subjected to erosion, resulting in the formation of erosion region 28.

Figure 3:
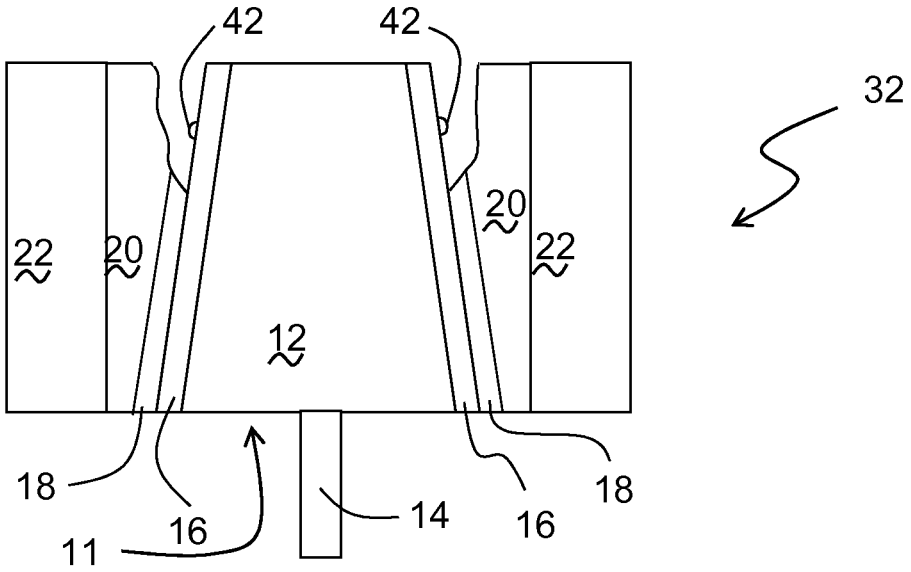
FIG. 3 is a section drawing showing a purge plug of the present invention in an eroded housing block, and the combination of the purge plug and housing block mounted in a ladle bottom.

FIG. 3 shows an assembly 32 of a purge plug 11, having a purge plug body 12 into which gas may be introduced through an inlet 14. The lateral face of purge plug 11 is enclosed in housing 16, and is held in block 20 by mortar 18. Block 20, which has been eroded, extends through floor 22 of a metallurgical vessel. Purge plug 11 is a replacement purge plug according to the present invention. One or more protrusions 42 extend from housing 16. Protrusions 42 are geometric features configured to engage refractory material that is placed in the eroded region of block 20. Protrusions 42 are configured and provided in a size so that purge plug 11 can be inserted into block 20 from the supply end of block 20, which is adjacent to the supply end of purge plug 11. Before the assembly is placed into use, additional refractory material is placed between block 20 and protrusions 42.

Figure 4:
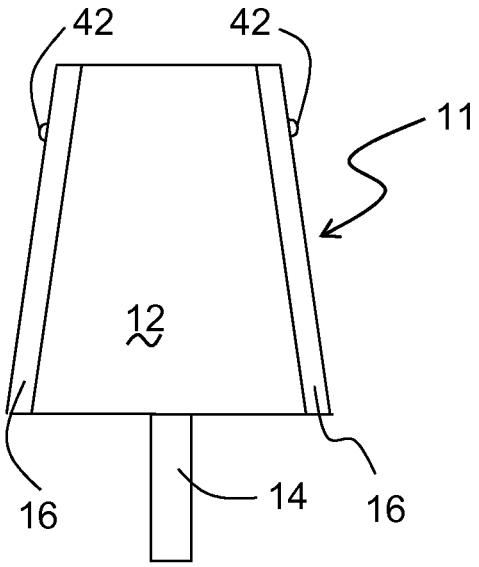
FIG. 4 is a section drawing showing a purge plug of the present invention having protrusions on a lateral face.

FIG. 4 shows a purge plug 11 having a purge plug body 12 into which gas may be introduced through an inlet 14. The lateral face of purge plug 11 is enclosed in housing 16. One or more protrusions 42 extend from housing 16.

Figure 5:
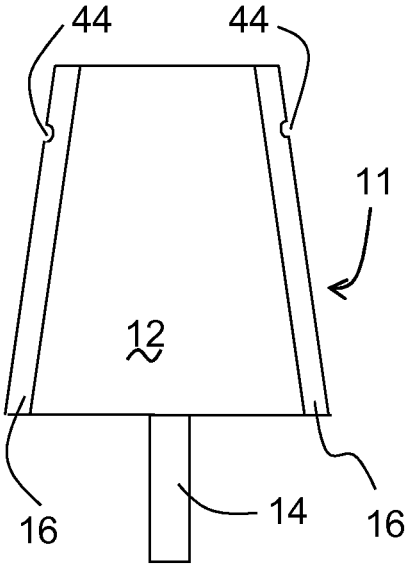
FIG. 5 is a section drawing showing a purge plug of the present invention having a circular indentation on a lateral face.

FIG. 5 shows a purge plug 11 having a purge plug body 12 into which gas may be introduced through an inlet 14. The lateral face of purge plug 11 is enclosed in housing 16. One or more indentations 44 extend into housing 16.

Figure 6:
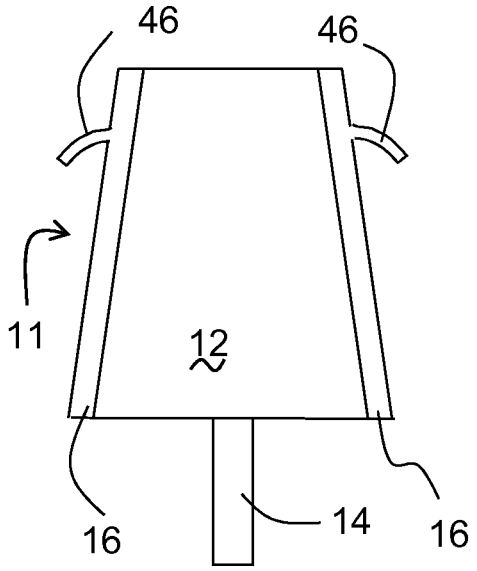
FIG. 6 is a section drawing showing a purge plug of the present invention having extended protrusions on a lateral face.

FIG. 6 shows a purge plug 11 having a purge plug body 12 into which gas may be introduced through an inlet 14. The lateral face of purge plug 11 is enclosed in housing 16. One or more anchors 46 extend from housing 16. These anchors may be rigid, in which case they are of an appropriate size to pass through the eroded opening of block 20 from its supply end. Anchors 46 may be flexible, in which case they may extend from purge plug 11 beyond the radius of the eroded opening of block 20, and may be bent or flexed in order to pass through the eroded opening of block 20.

Figure 7:
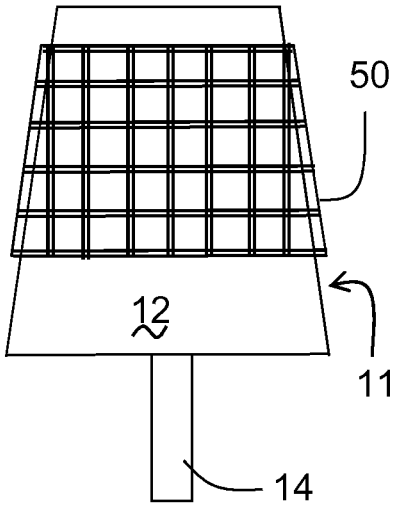
FIG. 7 is a side elevation drawing showing a purge plug of the present invention having a mesh surrounding a lateral face.

FIG. 7 shows a purge plug 11 having a purge plug body 12 into which gas may be introduced through an inlet 14. A portion of the lateral face of purge plug 14 is enclosed by a mesh or screen 50. The mesh or screen 50 is anchored to the lateral face of purge plug 14, and is configured so that it may pass through an eroded opening of a block in which the purge plug is to be installed.

Figure 8:
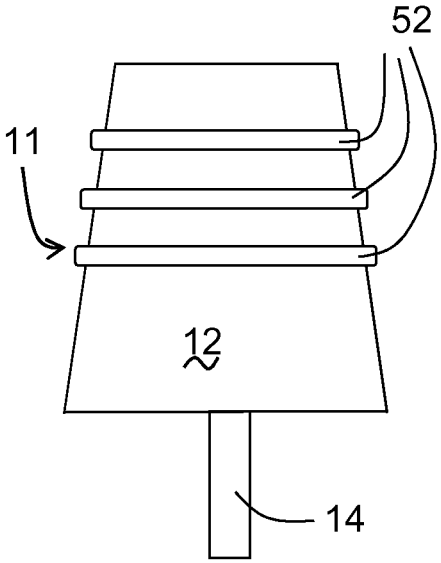
FIG. 8 is a side elevation drawing showing a purge plug of the present invention having bands surrounding a lateral face.

FIG. 8 shows a purge plug 11 having a purge plug body 12 into which gas may be introduced through an inlet 14. A portion of the lateral face of purge plug 14 is encircled by one or more geometrical features 52 such as rings or washers attached to the lateral face of purge plug 14. The rings or washers are configured so that they may pass through an eroded opening of a block in which the purge plug is to be installed. If the purge plug body is housed in a housing, the rings or washers are mounted on the housing.

Figure 9:
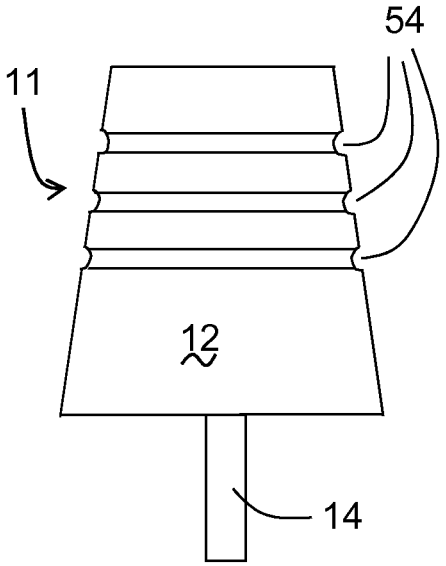
FIG. 9 is a side elevation drawing showing a purge plug of the present invention having recesses encircling a lateral face.

FIG. 9 shows a purge plug 11 having a purge plug body 12 into which gas may be introduced through an inlet 14. A portion of the lateral face of purge plug 14 is encircled by one or more geometrical features 54 such as indentations in the lateral face of purge plug 14. If the purge plug body is housed in a housing, the indentations are made in the housing.

Figure 10:
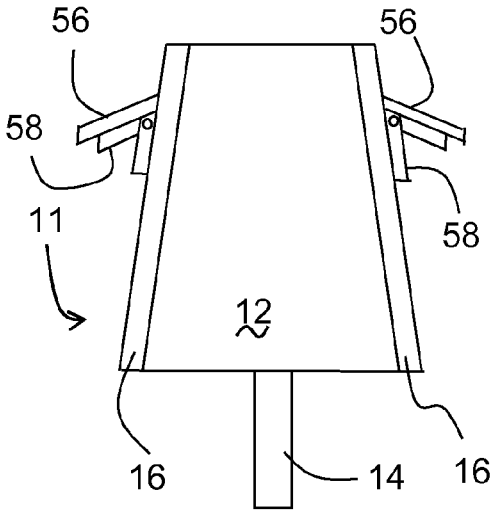
FIG. 10 is a section drawing showing a purge plug of the present invention having spring-loaded protrusions extending from a lateral face.

FIG. 10 shows a purge plug 11 having a purge plug body 12 into which gas may be introduced through an inlet 14. The lateral face of purge plug 11 is enclosed in housing 16. One or more anchors 56 extend from housing 16. The anchors 56 are mounted on springs 58, so that anchors 56 can be compressed to occupy a minimal extent from housing 16. The purge plug may then be inserted into an eroded opening of a block 20, and the anchors may then extend an increased distance from housing 16.

Figure 11:
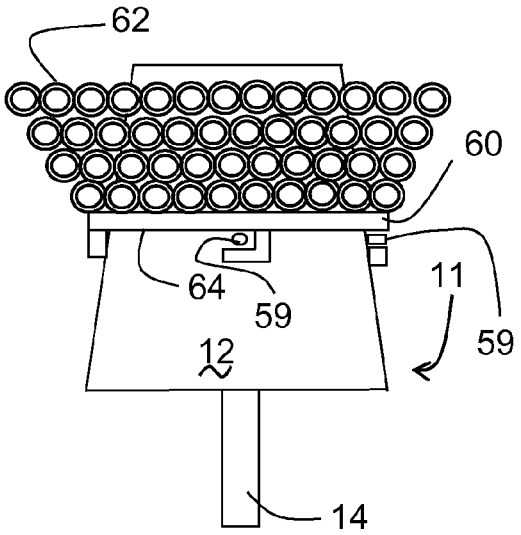
FIG. 11 is a side elevation drawing showing a purge plug of the present invention having a mesh basket surrounding a portion of a lateral face.

FIG. 11 shows a purge plug 11 having a purge plug body 12 into which gas may be introduced through an inlet 14. The purge plug may be housed in a purge plug housing. One or more locking pegs 59 extend from the lateral face of purge plug 11. A locking ring 60 encircles the lateral face of purge plug 11, and engages locking pegs 59 in a removable manner. Mesh 62 is attached to, and extends outwardly or laterally from, locking ring 60. Certain embodiments of mesh 62 extend outwardly from locking ring 60 and towards the working end of the purge plug assembly, in a basket configuration. The purge plug and mesh may be installed by installing the purge plug from the supply end of the block, and by introducing the locking ring 60 from the working end of the block. Locking ring 60 may then be twisted around purge plug 11 so that locking ring 60 engages locking pegs 59.

Figure 12:
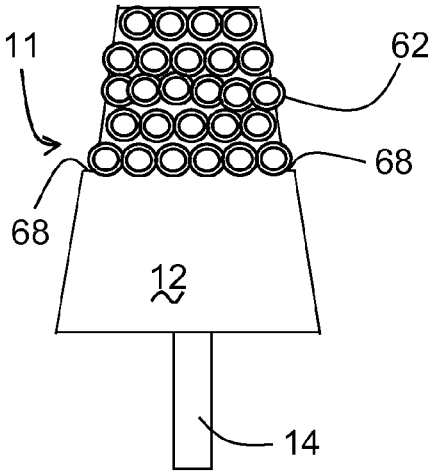
FIG. 12 is a side elevation drawing showing a purge plug of the present invention having a lateral face with a circumferential step and a mesh encircling a recessed portion of the lateral face.

FIG. 12 shows a purge plug 11 having a purge plug body 12 into which gas may be introduced through an inlet 14. The purge plug may be housed in a purge plug housing. The lateral face of purge plug 11 contains a lateral face step 68, so that there is a discontinuity in the radius of the lateral face of purge plug 11. The discontinuity produces a stepped decrease in the lateral radius of the plug on proceeding towards the working end of purge plug 11. The working end of purge plug 11 has a decreased lateral radius to accommodate mesh 62, which encircles the working end of the lateral face of purge plug 11.

Figure 13:
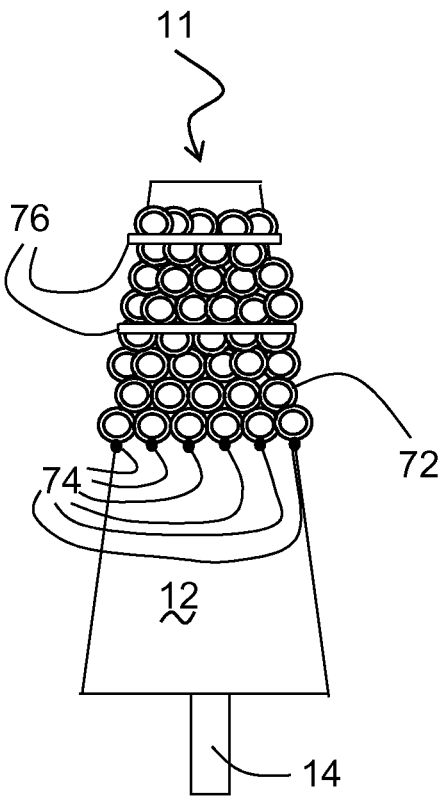
FIG. 13 is a side elevation drawing showing a purge plug of the present invention having a compressed mesh surrounding a lateral face, and bands encircling the mesh.

FIG. 13 shows a purge plug 11 having a purge plug body 12 into which gas may be introduced through an inlet 14. The purge plug may be housed in a purge plug housing. A mesh 72 encircles a portion of the lateral face of the working end of purge plug 11. One end of mesh 72 is attached to the lateral face of purge plug 11 by attachments 74 which may be, for example, tack welds. In the embodiment shown, the attachments are arranged radially around the lateral face of purge plug 11. Mesh 72 is compressed against the lateral face of purge plug 11 by one or more bands 76. Mesh 72 may be configured so that, on the release of bands 76, mesh 72 assumes an inverted conical frustum configuration around purge plug 11. Bands 76 may be made of metal and may be severed by cutting or by mechanical release, or may be made of a combustible material and severing may be accomplished by combustion.

Figure 14:
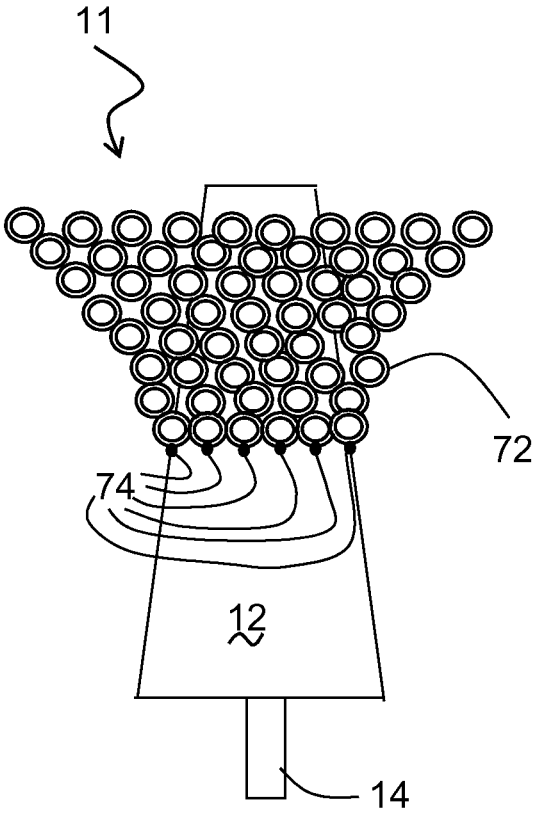
FIG. 14 is a side elevation drawing showing a purge plug of the present invention having a deployed mesh basket surrounding a lateral face.

FIG. 14 shows the purge plug 11 of FIG. 13 after bands 76 in FIG. 13 have been removed. The purge plug may be housed in a purge plug housing. Purge plug 11 has a purge plug body into which gas may be introduced through an inlet 14. Mesh 72 remains attached equatorially to the lateral face of purge plug 11 by attachments 74 which may be, for example, tack welds. Mesh 72 has assumed an inverted conical frustum configuration around purge plug 11. In other embodiments of the invention, the mesh may assume other configurations on expansion.

Figure 15:
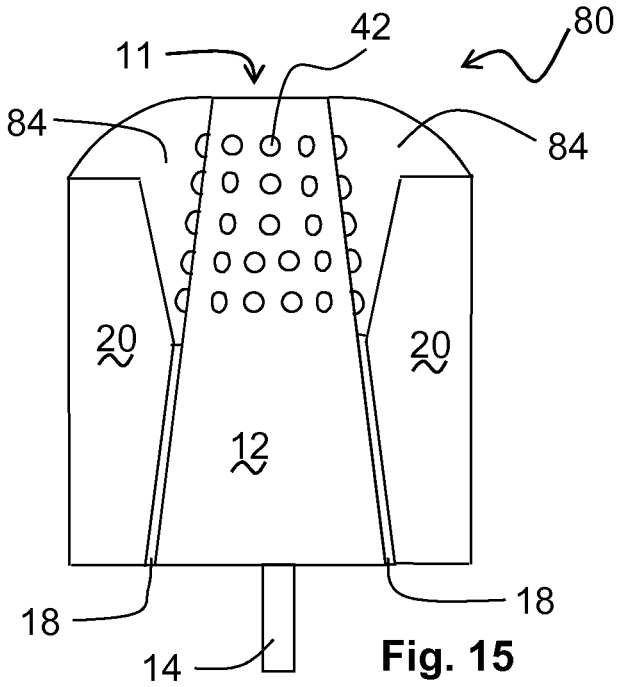
FIG. 15 is a cutaway drawing showing a purge plug of the present invention installed in an eroded housing block.

FIG. 15 shows a purge plug assembly 80 of the present invention containing purge plug 11, having a purge plug body 12 into which gas may be introduced through an inlet 14. The lateral face of purge plug 11 may be enclosed in a housing. The lateral face of purge plug, whether unenclosed or enclosed in a housing, houses a plurality of protrusions 42. The purge plug is held in block 20 by mortar 18. The purge plug is a replacement purge plug that has been inserted into a block that has been subjected to erosion, resulting in the formation of an erosion region. The erosion region has been filled with repair refractory material 84.

Figure 16:
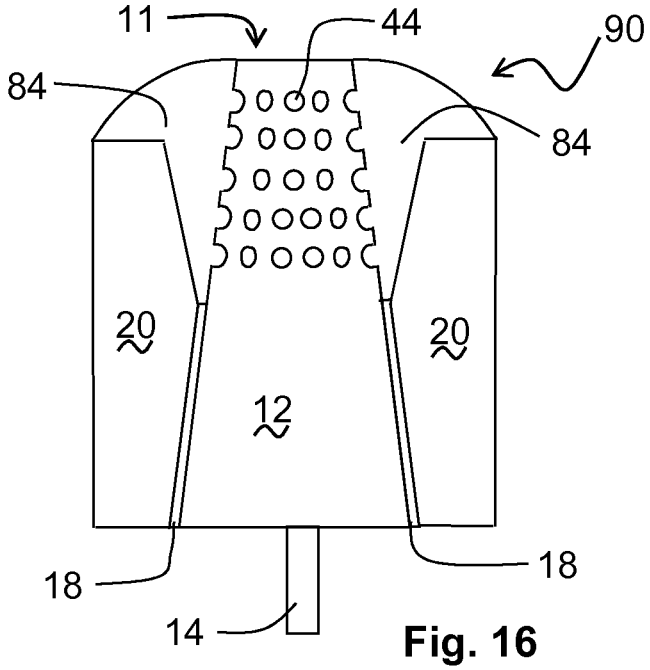
FIG. 16 is a cutaway drawing showing a purge plug of the present invention installed in an eroded housing block.

FIG. 16 shows a purge plug assembly 90 of the present invention containing purge plug 11, having a purge plug body 12 into which gas may be introduced through an inlet 14. The lateral face of purge plug 11 may be enclosed in a housing. The lateral face of purge plug, whether unenclosed or enclosed in a housing, houses a plurality of indentations 44. The purge plug is held in block 20 by mortar 18. The purge plug is a replacement purge plug that has been inserted into a block that has been subjected to erosion, resulting in the formation of an erosion region. The erosion region has been filled with repair refractory material 84.

In another embodiment of the invention, excess mortar applied over anchors or other geometrical features on the lateral face of the purge plug before installation of the plug may be substituted for, or combined with, repair refractory material introduced by bombing or gunning.

Erosion of housing blocks can take different forms, ranging from a small volume of erosion on the inside of the block mating surface to a very high degree of wear and a "U" shaped geometry (open to the working end) inside the housing block at its working end for a housing block originally having a conical inside surface with the larger diameter at the supply end.

Materials employed for geometrical features on the lateral face of the purge plug may include carbon steel, stainless steel and high temperature fiber materials, and may function over the temperature range of 2000° F. to 2600° F. (1100° C. to 1430° C.).

Geometrical features on the lateral face of the purge plug may protrude, may be indented or may combine indentations and protrusions. These geometrical features may include mesh, grilles, protrusions, ribs, fins, ripples, ridges, dimples and recesses.

To produce a replacement plug having protruding rings, the rings may be inserted onto, or formed with the housing during its production. The rings anchor the repair material to the plug reducing the shearing and washing away of the repair material. This configuration protects the plug and extends the life of the purge plug.

To produce a replacement plug having indentations, the indentations may be formed in the housing during its production. These indentations anchor the repair material to the plug reducing the shearing and washing away of the repair material. This configuration protects the plug and extends the life of the purge plug.

A replacement plug having ribs on the lateral face can be produced by welding washers to the external surface of the housing. These washers anchor the repair material to the plug reducing the shearing and washing away of the repair material. This configuration protects the plug and extends the life of the purge plug.

A replacement plug having protruding nubs on the lateral surface can be produced by welding nubs to the external surface of the housing. These nubs anchor the repair material to the plug reducing the shearing and washing away of the repair material. This configuration protects the plug and extends the life of the purge plug.

A replacement purge plug with having flexible or spring wire on the lateral surface can be produced by welding the wire to the steel can and then tying the wire with string or rope to restrain it until the plug is inserted into the housing block and the wire has cleared the portion of the internal surface of the block having a minimum diameter. The string may then be burned off when the plug is installed in a hot ladle. The repair material may then be anchored to the plug reducing the shearing and washing away of the repair material. This configuration protects the plug and extends the life of the purge plug.

A replacement purge plug with steel mesh welded to the plug can be produced by attaching steel mesh to the plug in a manner by which the mesh clears the worn housing block during insertion but yet helps to secure the repair material to the plug. The steel mesh secures the repair material to the plug, reducing the shearing and washing away of the repair material. This configuration protects the plug and extends the life of the purge plug.

A replacement purge plug with spring type anchors can be produced by attaching anchors to the plug. The spring type anchors are configured to bend inwardly to clear, during insertion, the portion of the internal surface of the block having a minimum diameter. After insertion, the spring type anchors are able to spring out to anchor the repair material. This configuration allows anchors of increased length to be attached to the lateral surface of the plug housing while simultaneously permitting the plug to pass through the portion of the internal surface of the block having a minimum diameter. The anchors secure the repair material to the plug, reducing the shearing and washing away of the repair material. This configuration protects the plug and extends the life of the purge plug.

A replacement purge plug with a stepped, decreased diameter on its working end increases the available clearance when the purge plug is inserted into a block. This configuration permits anchors to be attached to the lateral surface of the housing while maintaining the available clearance between the exterior of the housing and the portion of the internal surface of the block having a minimum diameter. The anchors secure the repair material to the plug, reducing the shearing and washing away of the repair material. This configuration protects the plug and extends the life of the purge plug A replacement plug may be configured so that anchors can be attached from the working end of the plug. The anchors would thus be attached to plug after the replacement plug has been installed in the block. This could be done, for example, at the lancing station. A much larger anchor could be attached to the plug having this configuration as the plug would not need to clear the portion of the internal surface of the housing block having a minimum diameter during insertion.

The extent of protrusion or indentation is related to the effectiveness of these structures in holding refractory repair material in place after the replacement plug is installed. Protrusion or indentation structures having a protrusion or indentation extent greater than 5 mm, 1 cm, 2 cm or 4 cm may be effective with certain types of repair refractory material.

The area of protrusion or indentation, measured in the horizontal plane, relates to the effectiveness of these structures in holding refractory repair material in place after the replacement plug is installed. Protrusion or indentation structures having total areas (for all geometrical features) of protrusion or indentation, measured in the horizontal plane, greater than 5 $cm^2$, 10 $cm^2$, 25 $cm^2$, 50 $cm^2$ or 100 $cm^2$ may be effective with certain types of repair refractory material.

A purge plug of the present invention may therefore have a supply end, a working end, and a lateral surface joining the supply and the working end. The lateral surface contains a geometric feature protruding from, or indented into, the lateral surface. The purge plug may contain an inlet in communication with the supply end of the plug, and in fluid communication with the working end, such as a porous configuration or channels. The purge plug may further comprise a housing enclosing the lateral surface of the purge plug. The geometric feature may be at least one protrusion, at least one indentation, a combination of at least one protrusion and one indentation, a rigid anchor, a flexible anchor, a mesh, a ring, an indentation circumscribing the lateral surface, or at least one spring-mounted anchor. The purge plug may have a locking peg on its lateral surface, so that the peg can engage a locking ring attached to a mesh that extends outwardly from the ring. The lateral surface of the purge plug may have a stepped decrease, so that the portion of the lateral surface proximal to the working end is recessed. The purge plug may also be configured so that a mesh, attached to the plug by a plurality of attachments, such as tack welds, arranged radially around the lateral face of the purge plug, encircles a portion of the lateral face of the working end of the plug. The mesh may be configured to be compressed against the lateral face of the purge plug, and encircled by at least one severable band. The band may then be severed to permit the mesh to assume an expanded configuration.

Numerous modifications and variations of the present invention are possible. It is, therefore, to be understood that within the scope of the following claims, the invention may be practiced otherwise than as specifically described.

We claim:

1. A device comprising a refractory, comprising a supply end, a working end, and a lateral surface joining the supply end and the working end, wherein the lateral surface comprises an anchoring geometric feature protruding from or indented into the lateral surface, wherein the device is tapered from the supply end to the working end, wherein the device comprises a purge plug, and wherein the geometric feature comprises a feature selected from the group consisting of:

(a) at least one spring-mounted anchor;

(b) a locking peg, a locking ring configured to encircle the lateral surface of the purge plug and to engage with the locking peg, and wherein the locking ring further comprises a mesh extending laterally from the locking ring; and (c) a mesh encircling a portion of the lateral surface of the working end of the purge plug, and further comprising a plurality of attachments between the mesh and the lateral surface of the purge plug, wherein the attachments are arranged radially around the lateral surface of the purge plug.

2. The purge plug of claim 1, wherein the purge plug has a shape selected from the group consisting of a truncated cone and a truncated pyramid.

3. The purge plug of claim 1, wherein the anchoring geometric feature is located proximal to the working end of the refractory device.

4. The purge plug of claim 1, further comprising an inlet in communication with the supply end of the plug.

5. The purge plug of claim 4, wherein the inlet is in fluid communication with the working end.

6. The purge plug of claim 5, wherein a structure providing fluid communication is selected from the group consisting of porosity and channels.

7. The purge plug of claim 1, further comprising a housing enclosing the lateral surface of the purge plug.

8. The purge plug of claim 1, wherein the geometric feature comprises at least one protrusion.

9. The purge plug of claim 1, wherein the geometric feature comprises at least one indentation.

10. The purge plug of claim 1, wherein the geometric feature comprises a mesh.

11. The purge plug of claim 1, wherein the geometric feature comprises at least one ring.

12. The purge plug of claim 1, wherein the geometric feature comprises at least one indentation circumscribing the lateral surface.

13. The purge plug of claim 1, wherein the geometric feature comprises at least one spring-mounted anchor.

14. The purge plug of claim 1, wherein the geometric feature comprises at least one locking peg, wherein the purge plug further comprises a locking ring configured to encircle the lateral surface of the purge plug and to engage with the locking peg, and wherein the locking ring further comprises a mesh extending laterally from the locking ring.

15. The purge plug of claim 1, further comprising a stepped decrease in the lateral radius of the plug, forming a recess on the portion of the lateral surface proximal to the working end.

16. The purge plug of claim 1, wherein the geometric feature comprises a mesh encircling a portion of the lateral surface of the working end of the purge plug, and further comprising a plurality of attachments between the mesh and the lateral surface of the purge plug, wherein the attachments are arranged radially around the lateral surface of the purge plug.

17. The purge plug of claim 16, further comprising at least one severable band encircling the mesh, and wherein the mesh assumes an expanded configuration when the band is severed.

* * * * *